United States Patent [19]

Scholz

[11] 4,186,172

[45] Jan. 29, 1980

[54] MONOLITHIC CATALYTIC MUFFLER HAVING NONDEPOSIT WELDS

[75] Inventor: Rainer Scholz, Ingolstadt, Fed. Rep. of Germany

[73] Assignee: Audi Nsu Auto Union Aktiengesellschaft, Neckarsulm, Fed. Rep. of Germany

[21] Appl. No.: 903,059

[22] Filed: May 5, 1978

[30] Foreign Application Priority Data

May 6, 1977 [DE] Fed. Rep. of Germany ..... 2720322
Jun. 22, 1977 [DE] Fed. Rep. of Germany ..... 2727967

[51] Int. Cl.[2] ..... B21D 53/00; B21D 53/02; F01N 3/15

[52] U.S. Cl. ..... 422/180; 29/157 R; 60/299; 60/322

[58] Field of Search ..... 23/288 FC; 29/157 R; 219/121 EM, 121 LM; 228/173 C, 173 D; 422/180; 60/299, 322

[56] References Cited

U.S. PATENT DOCUMENTS

| | | | |
|---|---|---|---|
| 3,185,815 | 5/1965 | Anderson | 219/121 EM |
| 3,208,131 | 9/1965 | Ruff et al. | 23/288 FC |
| 3,560,700 | 2/1971 | Reidelsturz | 219/121 EM |
| 3,960,624 | 6/1976 | Erlandson | 219/121 LM |

FOREIGN PATENT DOCUMENTS

| | | | |
|---|---|---|---|
| 1412650 | 11/1975 | United Kingdom | 23/288 FC |

*Primary Examiner*—Joseph Scovronek
*Assistant Examiner*—Bradley Garris
*Attorney, Agent, or Firm*—Karl F. Ross

[57] ABSTRACT

A catalytic muffler is formed by winding together a pair of relatively thin catalytically active foils one of which is corrugated. The wound-together foils are secured together by nondeposit welding to form a rigid insert having longitudinally throughgoing gas passages. This insert is then fitted into a cylindrical housing and welded to the housing once again using a beam-type welder.

13 Claims, 4 Drawing Figures

MONOLITHIC CATALYTIC MUFFLER HAVING NONDEPOSIT WELDS

FIELD OF THE INVENTION

The present invention relates to a catalytic converter. More particularly this invention concerns such a converter usable as a muffler in a motor vehicle.

BACKGROUND OF THE INVENTION

A monolithic metal catalytic converter is usually preferred to the supported-catalyst type of converter because of the high surface-area:mass ratio. It is therefore possible with a monolithic metal catalytic converter to achieve excellent results and considerable treatment with a very small unit.

The supported-catalyst converters have, however, the advantage that they are considerably more robust. In such arrangements the catalyst, normally a metal oxide, is carried on a ceramic substrate so that the unit can be made extremely robust. As the catalytically active metal used in the monolithic metal catalytic converters is extremely expensive, such metal is normally used in the form of very thin foils. Thus a monolithic metal catalytic converter is normally relatively fragile. Furthermore when such a converter is used as a catalytic muffler in a motor vehicle it frequently becomes internally loose so that the parts rattle and, indeed, frequently form a sort of resonator that completely impairs the muffler function.

OBJECTS OF THE INVENTION

It is therefore an object of the instant invention to provide an improved catalytic converter and method of making same.

Another object is the provision of such a converter usable as a catalytic muffler and of the monolithic metal type.

SUMMARY OF THE INVENTION

These objects are attained according to the present invention in a monolithic catalytic muffler formed of a first and second metal foil which are wrapped together to form a plurality of throughgoing passages and which contact each other at a multiplicity of locations. These foils are welded together at a plurality of the contact locations to unite the two foils into a monolithic and rigid insert. A housing snugly surrounds and contacts this insert and in turn is fixed to it.

Thus the muffler according to the instant ivention has as its catalytically active part a passage-forming insert that is absolutely rigid. The foils can both be catalytically active and of thicknesses of less than 100 microns, normally 50 microns. Thus the muffler has an extremely short startup time, as the mass of the catalytically active parts is very small so that the arrangement can heat up very rapidly to operating temperature. What is more, even these relatively thin foils are so rigidly interconnected by means of the welds, preferably of the nondeposit type, that loosening of the various parts relative to each other is impossible.

According to this invention the welding-together of the two foils to form the insert is carried out by means of an electron-beam or laser-beam welder that forms welds at its focus between contact surfaces of the two foils. This can be easily accomplished in a mass-production operation by displacing the assembled insert past several differently directed welding beams, with each welding beam forming a line or plane of welds through the insert.

It is possible according to this invention to weld the outermost layer of the insert to the housing. This can once again be achieved in a mass-production operation by displacing the fitted-together insert and housing past a welding beam which will form a continuous or discontinuous line of welds at the interface between this outermost layer and the housing. The fitted-together housing and insert can be rotated about the longitudinal axis of the muffler at the same time they are displaced therepast so that the connecting weld is a helix.

According to yet another feature of this invention as the two foils are wrapped together to form the insert they are displaced past a welding beam which welds them together as they are wound up to form the insert. Once again the welding between the layers of the insert and between the insert and the housing insures that the finished muffler will effectively be a single integral piece, and that any shifting of the internal parts relative to each other will be completely impossible.

SPECIFIC DESCRIPTION

Figure 1:
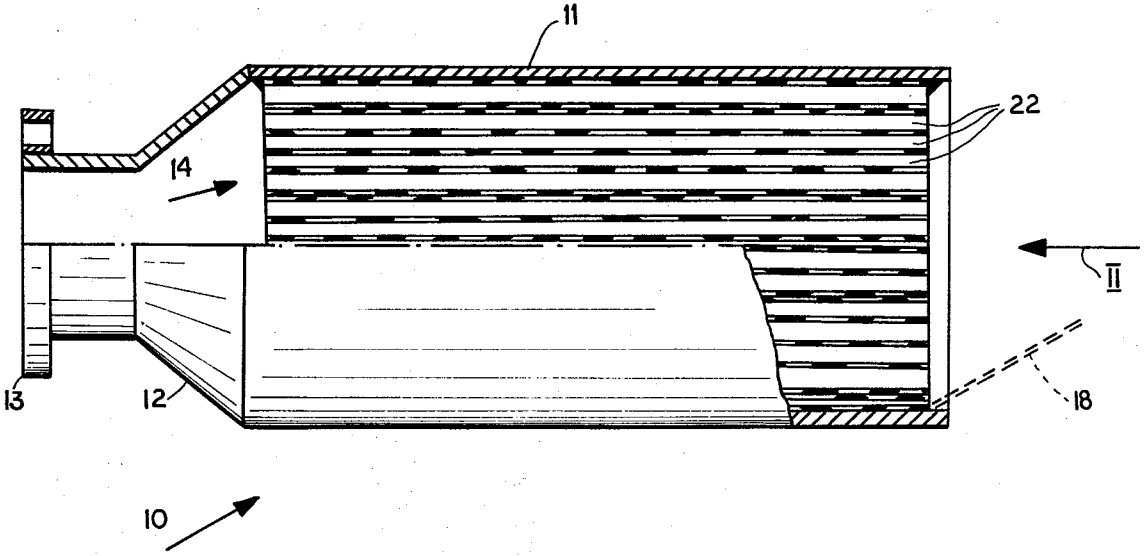
FIG. 1 is a side partly longitudinally sectional view through a muffler according to this invention.

As shown in FIG. 1 a catalytic muffler 10 has a cylindrical housing 11 which terminates when the muffler is fully assembled at both ends in a frustoconical end portion 12 having an attachment flange 13. Inside the cylindrical housing 11 there is provided a monolithic cylindrical insert 14 constituted as a pair or catalytically active metal foils 15 and 16 of which the former is corrugated and the latter flat so that the two form axially throughgoing gas passages 22. The foils 15 and 16 both have a thickness of approximately 0.05 mm, or approximately 2 mils.

Figure 2:
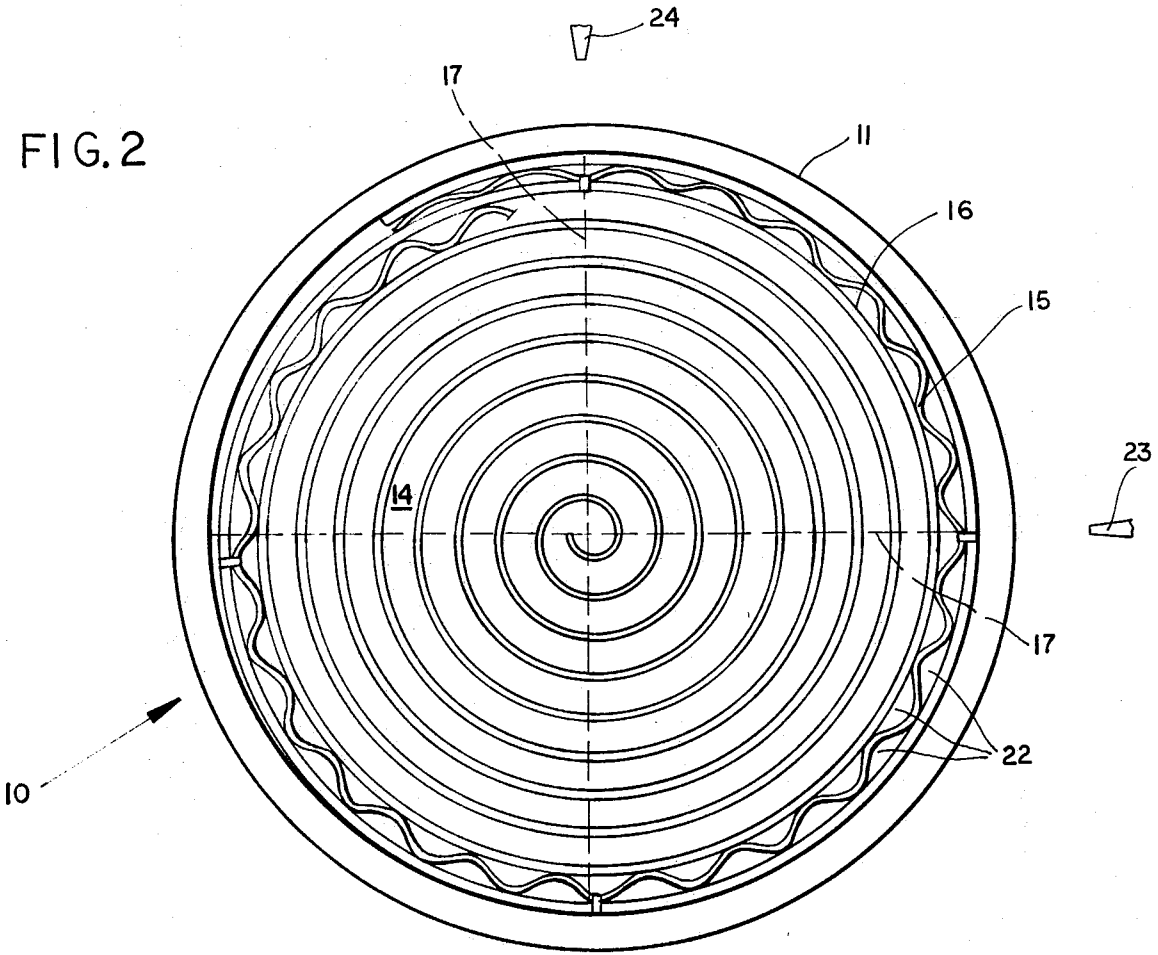
FIG. 2 is a view taken in the direction of arrow II of FIG. 1.

Such a muffler is produced by first rolling together two foils 15 and 16 to form the insert 14 which is then displaced past welding guns 23 and 24 as shown in FIG. 2 to weld the foils 15 and 16 together along two perpendicular diametral planes 17. FIG. 2 only shows the outermost turn of the corrugated foil 15 for clarity of view. Thereafter the welded-together insert is fitted into the housing and a laser beam 18 shown in FIG. 1 is directed at the ends to form a fillet weld with the housing 11. This fillet weld can extend over the entire circumference of the insert 14 or can be merely formed at spaced-apart locations between the housing 11 and the insert 14. The outer winding is secured together by a discontinuous weld. This operation can take place at the same time as the welding of the ends of the insert 14.

After thus welding the insert 14 into the housing 11 the other end part 12 with its flange 13 is secured to the housing 11 by welding also.

Figure 3:
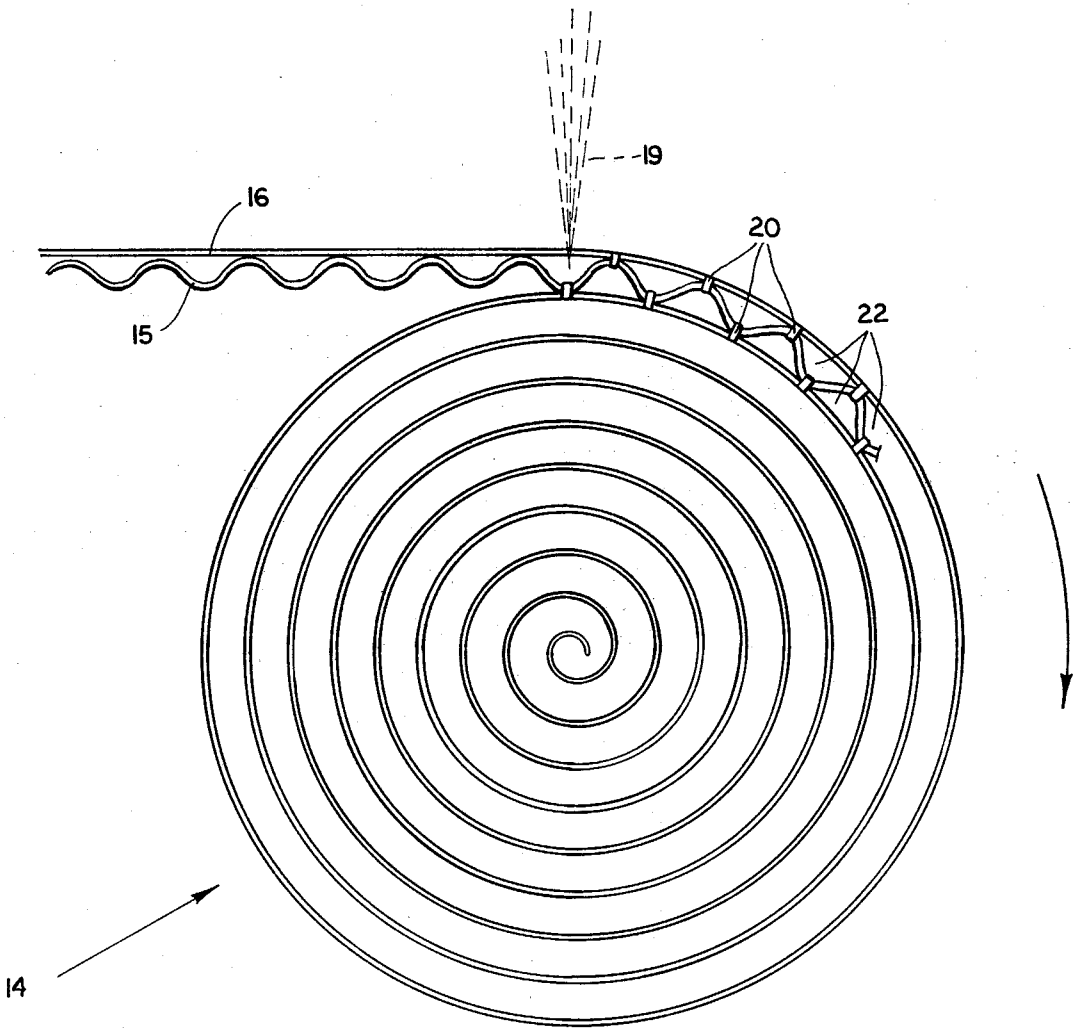
FIG. 3 is an end view illustrating the assembly of the insert of another muffler according to this invention.
Figure 4:
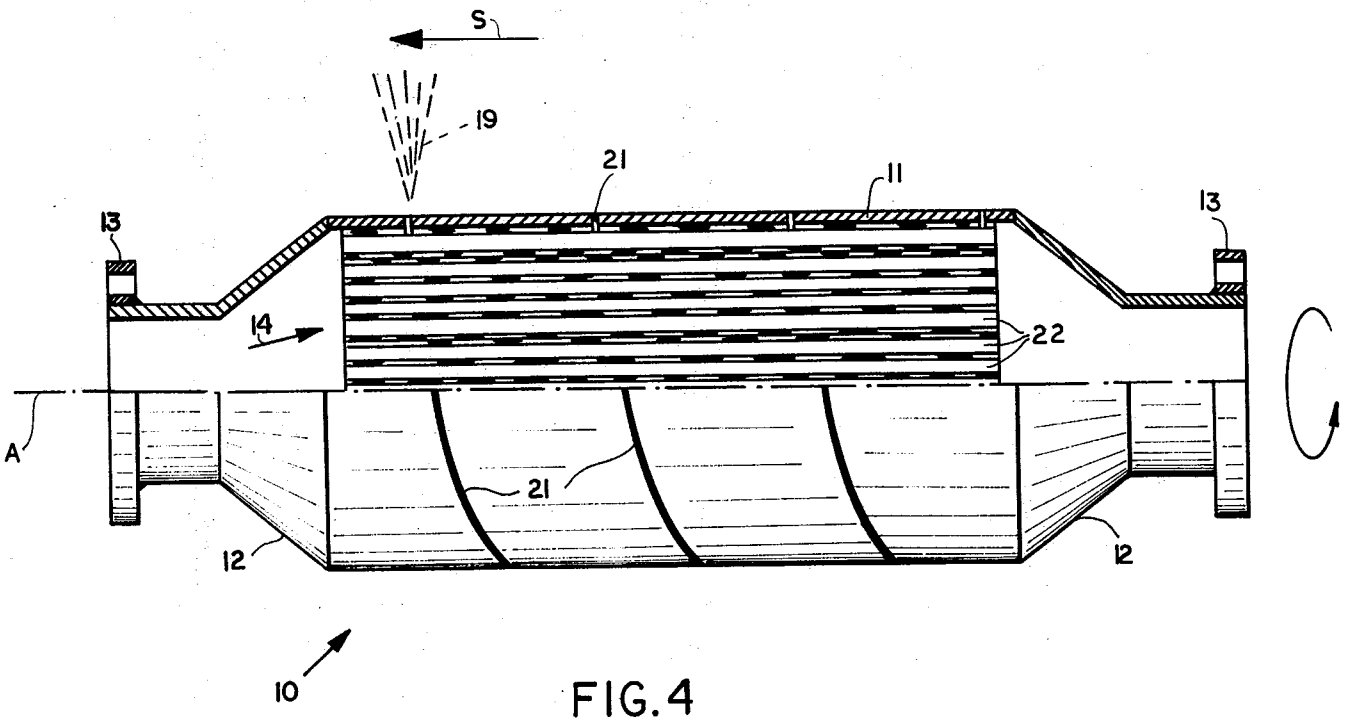
FIG. 4 is a view similar to FIG. 1 illustrating the other muffler according to this invention.

FIGS. 3 and 4 illustrate the manufacture of another catalytic muffler according to this invention. In this arrangement the two foils 15 and 16 of the monolithic insert 14 are wound together and simultaneously displaced past a fixed electron-beam welder having a beam 19. This forms welds 20 between the foils 15 and 16 which allows the very thin foils to be secured together into a very stiff resonant-free insert 14. The welding can take place in a vacuum using, for example, the automatic welding machine of the T15 type described in the brochure "Elektronenstrahltechnik" of Steigerwald Strahltechnik GmbH, 8031 Puchheim/Munich. This welding can take place continuously or discontinuously by switching on and off the electron-beam gun.

After thus assembling the insert and welding it together it is fitted into the housing 11 which is displaced in direction s past a fixed welding beam 19 while rotating the entire assembly about its longitudinal axis A. This forms a helical weld 21 between the housing 11 and the outer layer of the insert 14.

I claim:

1. A catalytic muffler comprising:

a first metal foil;

a second metal foil wrapped with said first foil and forming therewith a plurality of throughgoing gas passages, said foils contacting each other at a multiplicity of locations, at least one of said foils being catalytically active;

nondeposit welds between said foils at a plurality of said locations uniting said foils into a monolithic and rigid insert;

a housing snugly surrounding and contacting said insert; and nondeposit welds between said housing and said insert fixing same rigidly together.

2. The muffler defined in claim 1 wherein one of said foils is corrugated with its corrugations extending in line with and defining said passages.

3. The muffler defined in claim 2 wherein the other of said foils is flat.

4. The muffler defined in claim 2 wherein both of said foils are catalytically active and have thicknesses of at most 100 microns.

5. A method of making a catalytic muffler comprising the steps of:

wrapping together a pair of catalytically active metal foils into a body having a plurality of throughgoing gas passages with said foils in contact with each other between said passages at a multiplicity of locations;

nondeposit welding together said foils at a plurality of said locations to form same body into a rigid insert by advancing said foils adjacent a fixed-beam welder; and fitting said insert into a housing and rigidly securing same therein.

6. The method defined in claim 5 wherein said foils are welded together as they are wrapped together.

7. The method defined in claim 5 wherein said insert is welded along a generally spiral seam to said housing by rotating and advancing said insert and housing past a fixed beam welder.

8. The method defined in claim 5 wherein said insert is generally cylindrical and said foils are welded together along at least one generally diametral plane.

9. The method defined in claim 5 wherein one of said foils is corrugated and the other foil is generally flat and said foils are wound together spiral-fashion.

10. The method defined in claim 5, further comprising the step of nondeposit welding said insert to said housing after fitting of said insert therein to rigidly secure said insert and housing together by means of a beam welder directed into the end of said housing.

11. The method defined in claim 10 wherein said welding is carried out with a laser beam.

12. The method defined in claim 10 wherein said welding is carried out with an electron beam.

13. The method defined in claim 10 wherein said foils are welded together as they are wrapped together.

* * * * *